US007007309B1

(12) United States Patent
Mende

(10) Patent No.: US 7,007,309 B1
(45) Date of Patent: Mar. 7, 2006

(54) DANCE TIGHT STOCKING

(76) Inventor: Mindi Mende, 1401 Penman Rd., Jacksonville Beach, FL (US) 32250

( * ) Notice: Subject to any disclaimer, the term of this patent is extended or adjusted under 35 U.S.C. 154(b) by 0 days.

(21) Appl. No.: 10/737,489

(22) Filed: Dec. 16, 2003

(51) Int. Cl.
*A41B 11/00* (2006.01)

(52) U.S. Cl. ..... 2/239; 2/409

(58) Field of Classification Search ..... 2/239–242, 2/406–409, 69; D2/980, 983; 450/114–117, 450/131, 132; 602/60–66, 75–77
See application file for complete search history.

(56) References Cited

U.S. PATENT DOCUMENTS

| | | | | | |
|---|---|---|---|---|---|
| 1,518,758 | A | * | 12/1924 | Rodee | 2/61 |
| 1,543,353 | A | | 6/1925 | Wolff | |
| 1,811,786 | A | * | 6/1931 | Frei | 66/187 |
| 1,968,832 | A | * | 8/1934 | Hinchliff | 2/239 |
| 1,999,929 | A | * | 4/1935 | Hearn | 2/239 |
| 2,179,124 | A | | 11/1939 | Jesnig | |
| 2,203,401 | A | * | 6/1940 | Barnard | 2/407 |
| 2,332,252 | A | * | 10/1943 | Payne | 36/106 |
| 2,334,206 | A | * | 11/1943 | Knohl | 66/187 |
| 2,826,760 | A | | 3/1958 | Rice | |
| 2,968,937 | A | | 1/1961 | Margulies | |
| 3,090,963 | A | | 5/1963 | Wittman | |
| 3,111,676 | A | | 11/1963 | Artzt et al. | |
| 3,329,972 | A | | 7/1967 | Schwab et al. | |
| 3,605,122 | A | | 9/1971 | Myers | |
| 3,975,929 | A | * | 8/1976 | Fregeolle | 602/63 |
| 4,027,667 | A | * | 6/1977 | Swallow et al. | 602/63 |
| 4,069,515 | A | * | 1/1978 | Swallow et al. | 2/239 |
| 4,180,869 | A | * | 1/1980 | Pedergrass et al. | 2/240 |
| 4,181,982 | A | | 1/1980 | Segovia | |
| 4,322,894 | A | | 4/1982 | Dykes | |
| 4,424,596 | A | * | 1/1984 | Jackson | 2/240 |
| 4,756,027 | A | | 7/1988 | Buenos et al. | |
| 5,054,129 | A | | 10/1991 | Baehr | |
| 5,067,179 | A | | 11/1991 | Wormser | |
| 5,109,546 | A | * | 5/1992 | Dicker | 2/70 |
| D345,045 | S | | 3/1994 | Atkins et al. | |
| D358,703 | S | * | 5/1995 | Moffre et al. | D2/983 |
| 5,473,781 | A | | 12/1995 | Greenberg | |
| 5,682,617 | A | * | 11/1997 | Tumas | 2/239 |
| 5,749,100 | A | | 5/1998 | Rosenberg | |
| 5,867,838 | A | * | 2/1999 | Corry | 2/239 |
| 6,047,571 | A | | 4/2000 | Juniman | |
| 6,158,253 | A | | 12/2000 | Svoboda et al. | |
| 6,226,800 | B1 | * | 5/2001 | Islar | 2/239 |
| 6,367,087 | B1 | * | 4/2002 | Spillman et al. | 2/239 |
| 6,415,448 | B1 | | 7/2002 | Glogover | |
| 2002/0108166 | A1 | * | 8/2002 | Abboud | 2/239 |

* cited by examiner

*Primary Examiner*—Alissa L. Hoey
(74) *Attorney, Agent, or Firm*—Richard S. Vermut; Rogers Towers, P.A.

(57) ABSTRACT

An improved dance tight and dance tight stocking. In accordance with one embodiment, the dance tight includes a leg portion in the form of a tubular fabric member terminating in a foot portion. The foot portion includes an open forefoot collar bordered by an elastic finished edge and through which a wearer's toes protrude when the dance tight stock is worn. An open hindfoot collar is disposed on the foot portion proximally with respect to the forefoot collar such that a portion of the rear heel surface of the wearer's foot is exposed therethrough. The dance tight stocking further includes an instep collar defining an elastically bounded open mouth through the leg portion in substantial longitudinal alignment between the forefoot collar and the hindfoot collar such that forefoot and hindfoot retention bands are formed therebetween.

8 Claims, 3 Drawing Sheets

DANCE TIGHT STOCKING

BACKGROUND OF THE INVENTION

1. Technical Field

The present invention relates in general to fitted garments such as are worn for dance performances and practice, and in particular, to an improved dancewear design providing increased comfort and utility without diminishing dancewear aesthetics. More particularly, the present invention relates to a dance tight having an improved foot stocking designed for providing maximum comfort and utility when worn for dance, gymnastics, and the like.

2. Description of the Related Art

Specially styled dance garments and costumes are often required for a variety of reasons relating to performance functionality and aesthetics. This is particularly true, for example, in classic dance practice and performance forums in which dancers are required to wear one or more skintight garments covering the body from the neck down or from the waist down. As utilized herein, "tights" refer generally to such formfitting pant-like garments such as leortards, unitards and the like worn from the upper body, hip, or leg level area down to the feet of the wearer.

A typical leotard dance tight design is elastically adhered around the wearer's waist and is anchored from the bottom by a particular stocking design. The three basic stocking designs used with dance tights include footed, footless and stirrup-type designs. Footless tights, as the name implies, have no foot covering or "stocking" portion and are used for practicing or performing dance, gymnastics, and the like, without shoes, while footed tights include generally enclosed pockets into which the wearer's feet are enclosed when the garment is worn in a similar manner as full footed pantyhose. Stirrup designs utilize straps passing under the arches of the wearer's feet and in this manner are typically utilized to maintain a straight downward traction on the leg portions of the tights. A hybrid of the footless and footed tights design is disclosed in U.S. Pat. No. 6,047,571, issued to Juniman, which describes a stocking having a main tubular portion terminating at the foot end with a toe pocket portion and a foot opening collar. When the convertible stocking is worn, the foot opening collar forms an elastic aperture at approximately the mid-sole region of the bottom of the wearer's foot when the stocking is worn in the footed manner, and which may then be stretched around to release the foot therethrough when the stocking is worn in the footless manner.

As worn for dance performances, tights are used primarily for aesthetic reasons and for ballet dancing are worn with specialized footwear in the form of soft ballet shoes or pointe shoes. Ballerinas strive to achieve the illusion of weightless hovering by rapidly skimming the floor, spinning and sustaining poses on the tips of their toes, or "sur les pointes." The fundamental aesthetics of ballet call for a long, tapered line of the leg, which is enhanced by the almost conical shape of a ballet or pointe shoe. The aesthetic effect is enhanced by the continuity in appearance from the ballerina's foot to the ballerina's leg enabled by wearing footed dance tights that cover the otherwise exposed skin of the dancer's legs and feet including the top arch or metatarsus region of the feet. Footed tights are therefore worn by dancers under ballet or pointe shoes or other types of lower vamp or open-throat type dance shoes such as for jazz and tap dancing.

While preserving the appearance of continuity from the dancer's leg to the shoe, full footed stockings impose substantial confinement on the dancer's foot and toes resulting in diminished freedom of foot and toe movement and reducing the dancer's sensitivity and ability to sense or "feel" the disposition of his or her feet thus diminishing the desired "barefoot" feel. Furthermore, by virtually eliminating any direct skin-to-shoe contact, footed stockings potentially compromise the traction at various foot-to-shoes boundary points. The lack of skin-to-shoe contact at the back heel area is particularly problematic for losing backheel traction when wearing pointe shoes.

It can therefore be appreciated that a need exists for an improved dance tight stocking that preserves the continuity of appearance from the leg to the exposed top of the foot while eliminating the discomfort and reduced traction incident to footed stockings. The present invention addresses such a need.

SUMMARY OF THE INVENTION

An improved dance tight and dance tight stocking are disclosed herein. In accordance with one embodiment, the dance tight includes a leg portion in the form of a tubular fabric member terminating in a foot portion. The foot portion includes an open forefoot collar bordered by an elastic finished edge and through which a wearer's toes protrude when the dance tight stock is worn. An open hindfoot collar is disposed on the foot portion proximally with respect to the forefoot collar such that a portion of the rear heel surface of the wearer's foot is exposed therethrough. The dance tight stocking further includes an instep collar defining an elastically bounded open mouth through the leg portion in substantial longitudinal alignment between the forefoot collar and the hindfoot collar such that forefoot and hindfoot retention bands are formed therebetween.

All objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1B:
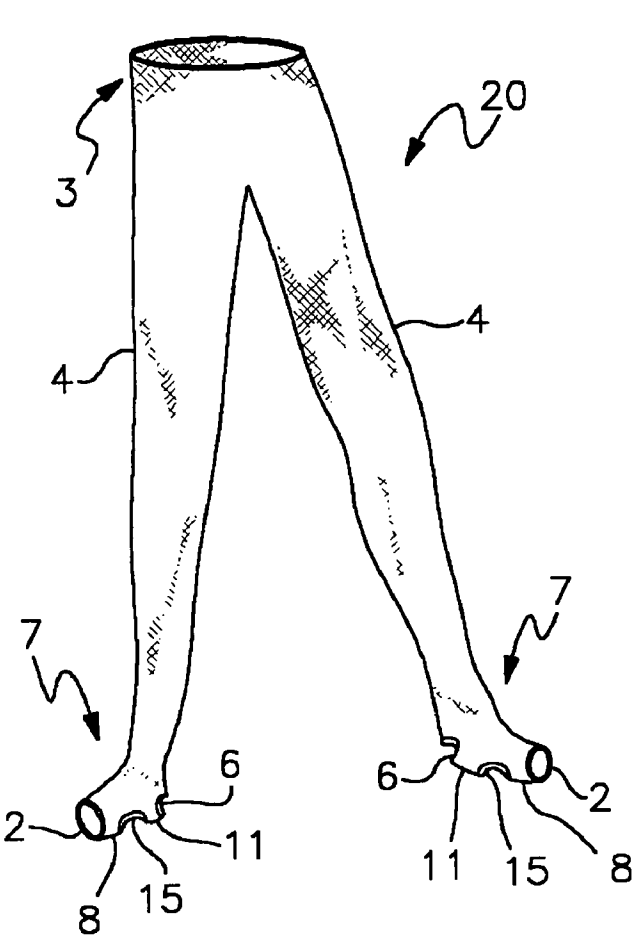
FIG. 1B shows an alternative embodiment of the dance tight of the present invention.

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention.

The present invention is generally directed to an improved dance tight and method for using the same which combine the open-toed feel and performance of open foot and stirrup-type tights with the top arch covering provided by footed tights. With reference now to the figures, wherein like reference numerals refer to like and corresponding parts throughout, and in particular with reference to FIG. 1A, there is illustrated a dance tight 10 in accordance with a preferred embodiment of the present invention. As shown in FIG. 1A, dance tight 10 generally comprises a pair of tubular fabric leg portions 4 extending from a hip portion 3. As continuous extensions at the distal ends of leg portions 4 are a corresponding pair of foot portions 5. As utilized herein, "foot portion" is used to mean and is interchangeable with "dance tight stocking," "foot stocking," "stocking," and other words or phrases used to denote the lower ankle and foot covering portions of a dance tight.

In accordance with a preferred embodiment of the present invention, each of foot portions 5 is generally fabricated as a continuous extension of the fabric material used for leg portions 4. Many types of suitable fabric materials maybe used for leg portions 4 and foot portions 5 including nylons, polyesters and other fabric materials having suitable flexibility and form-fitting properties well known to those skilled in the art. As depicted in FIG. 1A, each foot portion 5 includes a forefoot collar 2 defining an open mouth at the distal end of the corresponding foot portion 5. Bordering the outer distal edges of the foot portions 5, forefoot collar 2 generally comprises an elastic band having a higher elasticity or elastic traction than the adjacent fabric material, which is also preferably elastic to accommodate it function as a substantially body-conforming clothing article.

Each of foot portions 5 further includes an open hindfoot collar 6, which, similar to forefoot collar 2, preferably comprises an elastic band sewn onto, within or otherwise integrally fabricated to form a finished edge along the rim of the open mouth formed thereby. As shown in the depicted embodiment, hindfoot collar 6 is fabricated into foot portion 5 such that the open mouth defined thereby is disposed through a lateral side of foot portion 5 proximal (i.e. further up leg portion 4) with respect to forefoot collar 2. The distance separating hindfoot collar 6 from forefoot collar 2 is determined such that the wearer's toes extend through forefoot collar 2 while simultaneously the back surface 26 of the wearer's heel is exposed and partially protrudes through hindfoot collar 6. To this end, the distance between hindfoot collar 6 and forefoot collar will vary depending on the application, and in particular, depending on the size of the dance tight garment.

Foot portion 5 further includes an open instep collar 15 disposed in longitudinal alignment (i.e. parallel the lengthwise dimension of leg portion 4) between forefoot collar 2 and hindfoot collar 6. It should be noted that in accordance with the relative positioning principle set forth herein, the "proximal" orientation of hindfoot collar 6 and instep collar 15 with respect to forefoot collar 2 does not require that leg portion 4 and foot portion 5 be formed as a straight legged fabric member as shown in FIG. 1A.

Figure 1A:
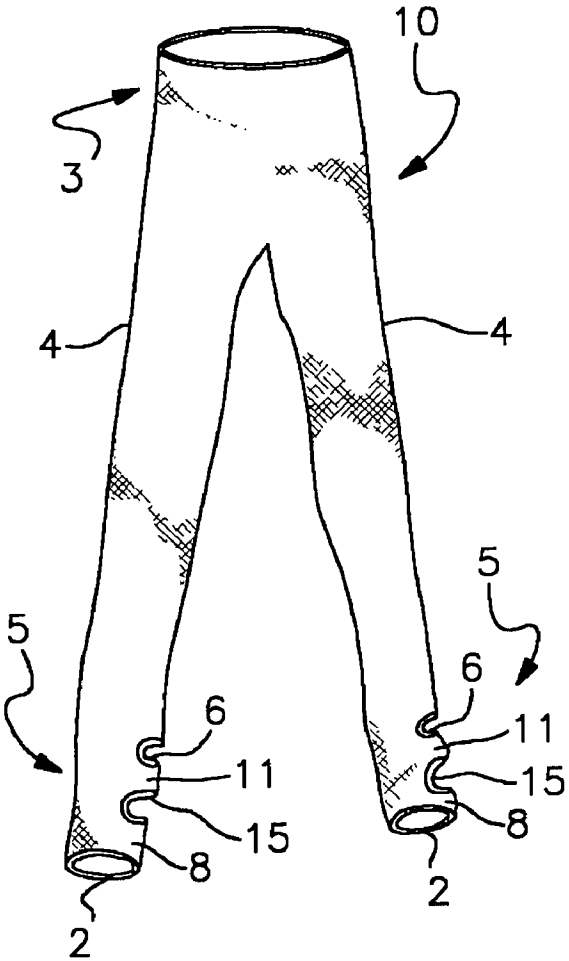
FIG. 1A illustrates a dance tight in accordance with a preferred embodiment of the present invention.

FIG. 1B depicts an alternative embodiment of a dance tight 20 of the present invention in which well-known knitting techniques are used to pre-form or pre-contour the stocking, or "foot portions" 7. Unlike the embodiment depicted in FIG. 1A, in which foot portions 5 are formed as straight, tube-like fabric members at the distal end of leg portions 4, foot portions 7 are contoured in conformity with the respective angling of the respective parts of the user's foot.

Figure 2A:
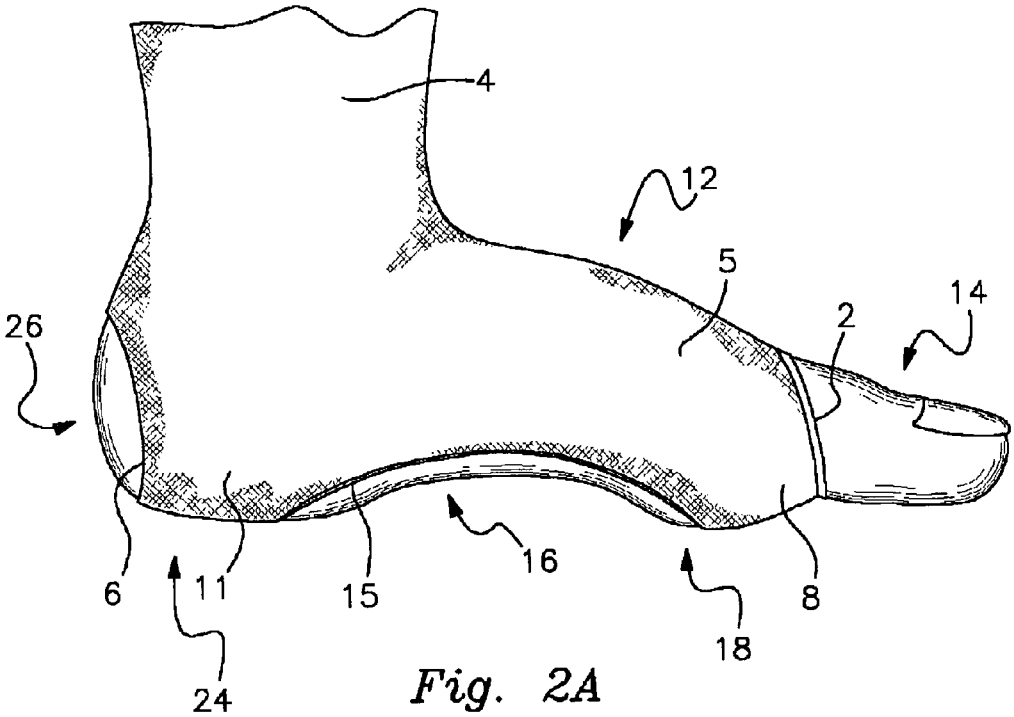
FIG. 2A is a side view depicting a dance tight as worn on the leg and foot of a wearer in accordance with a preferred embodiment of the present invention.

The significance of the relative positioning of the foregoing design features of foot portions 5 are best illustrated with reference to FIGS. 2A, 2B, and 2C, which depict alternate view perspectives of the foot portion of dance tight 10 as fitted onto a dancer's foot. As shown in FIG. 2A, the lateral side of foot portion 5 opposing instep collar 15 forms a midfoot fabric portion 12 that extends across the top arch or metatarsus midfoot region of the wearer's foot. The dimensions of instep collar 15 and hindfoot collar 6 in their respective elastically expanded disposition are preferably selected such that when dance tight 10 is worn, none of the exposed skin of the wearer's foot extends above, the back heel edge or the side vamp edges of the dance shoe (not depicted).

In the foregoing manner, when worn with low vamp or open throat dance shoes such as ballet shows, toe shoes, or other types of dance shoes, foot portion 5 fully covers the otherwise exposed top portion of the wearer's foot up to the boundaries of the open throat of the shoes as would be the case when footed tights are worn. While the metatarsus region is covered by midfoot fabric portion 12, the toes 14 of the foot extend through forefoot collar 2 at the terminal end of foot portion 5, enabling the dancer to enjoy the comfort and utility of having unrestrained toe movement within a dance shoe (not depicted) worn on the foot. In order to serve its collar function, the material constituting forefoot collar 2 is preferably an elastic band having a higher elastic traction or modulus of elasticity than the adjacent surrounding material making up the stretchable fabric portions of dance tight 10.

As further shown in FIG. 2A, a portion of the rear surface of the heel 26 is exposed and partially protrudes through the open mouth elastically defined by hindfoot collar 6. Similar to forefoot collar 2, hindfoot collar 6 preferably comprises an elastic band bounding the edge of the open mouth defined therethrough. The skin-to-shoe contact surface maintained at the back heel area of the dancer's foot through hindfoot collar 6 is useful for providing additional grip at the inside back heel portion of the shoe.

Figure 2B:
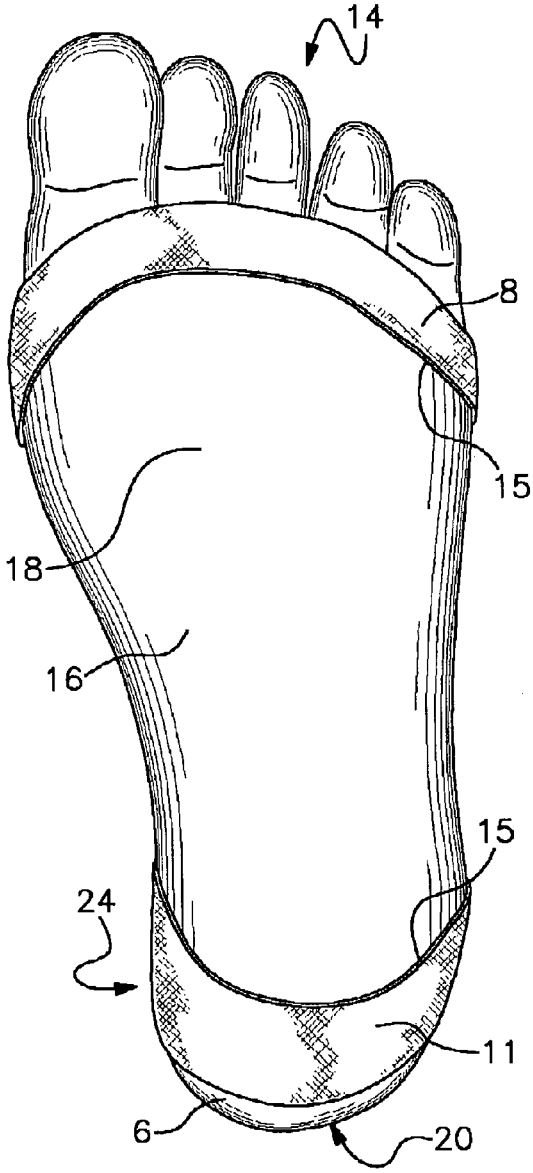
FIG. 2B is an underneath view depicting a dance tight as worn on the leg and foot of a wearer in accordance with a preferred embodiment of the present invention.
Figure 2C:
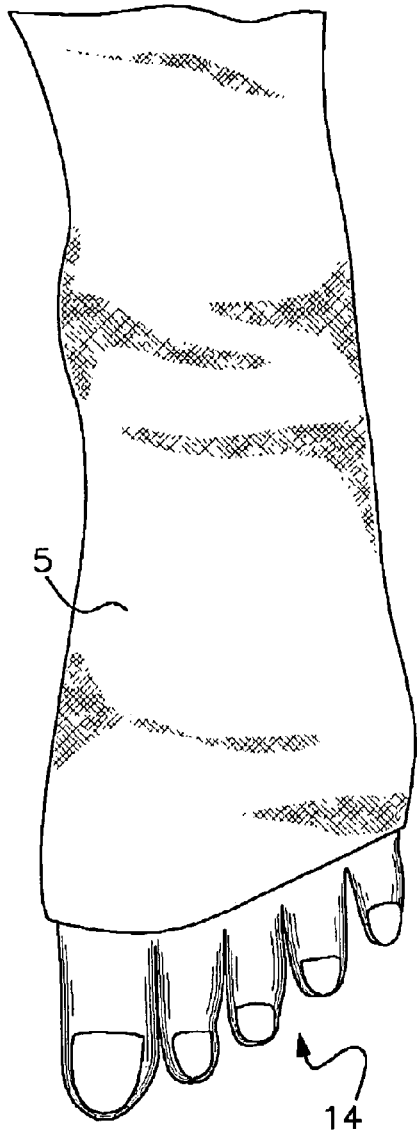
FIG. 2C is an overhead view illustrating a dance tight as worn on the leg and foot of a wearer in accordance with a preferred embodiment of the present invention.

As further depicted in FIGS. 2A and 2B, the positioning of instep collar 15 in longitudinal alignment between forefoot collar 2 and hindfoot collar 6 results in the arch 16 of the foot being exposed therethrough. When a soft dance shoe, such as a ballet or toe shoe is worn over foot portion 5, the resulting skin-to-shoe sole contact surface (not depicted) significantly improves comfort and ease of motion by increasing the dancer's sensation of being barefoot. As shown in the depicted embodiment, the relative disposition of instep collar 15 in longitudinal alignment between forefoot collar 2 and hindfoot collar 6 defines a forefoot retention band 8 and a hindfoot retention band 11 extending across the front of the ball of the foot 18 and the bottom and rear surfaces of the heel 24 of the foot, respectively. Forefoot retention band 8 applies a downward and forward traction on the foot portion fabric over midfoot fabric portion 12, thus maintaining the midfoot covered while hindfoot retention band 11 applies a downward and rearward traction that also facilitates in maintaining the ankle and sides of the foot covered. Forefoot retention band 8 and hindfoot retention band 11 thus serve a complementary role in maintaining opposing downward traction forces to maintain the midfoot region covered by the foot portion fabric 12 while the open mouths formed therebetween maintain skin-to-shoe contact at strategic locations on the foot.

In a preferred embodiment, as depicted in FIG. 2B, the "front" edge of instep collar 15 near the toes 14 is contoured in an arc-like manner following the contour of the ball of the foot for uniform forward and downward traction with minimal tension between the lateral sides causing forefoot retention band 8 to remain securely attached to the front ball of the foot 18. Similarly, the "rear" edge of instep collar 15 is also contoured in a rounded, arc-like manner following the contour of the heel 26 to provide similar uniform downward and rearward traction with minimal lateral tension across the foot.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. A dance tight comprising:

a foot portion terminating at its distal end in an open forefoot collar whereby the toes of a wearer extend through said forefoot collar such that the toes are exposed to directly contact the inner sole of a shoe;

an open hindfoot collar disposed on said foot portion proximally with respect to said forefoot collar whereby the back of the heel of a wearer extends through said hindfoot collar such that the back of the heel is exposed to directly contact the inner back of a shoe; and an open instep collar disposed on said foot portion between said forefoot collar and said hindfoot collar whereby the majority of the instep of a wearer is exposed by said instep collar, wherein said instep collar defines an open mouth through said foot portion in longitudinal alignment between said hindfoot collar and said forefoot collar such that a hindfoot retention band is formed between said instep collar and said hindfoot collar, whereby said hindfoot retention band is disposed across the bottom of the heel of a wearer, and a forefoot retention band is formed between said instep collar and said forefoot collar, whereby said forefoot retention band is disposed across the ball of the foot of a wearer.

2. The dance tight of claim 1, wherein said foot portion is made of a nylon or polyester material.

3. The dance tight of claim 1, wherein said foot portion comprises an elastic fabric material, said forefoot collar, said instep collar and said hindfoot collar comprising elastic bands having a higher elastic traction than the foot portion fabric material.

4. The dance tight of claim 1, further comprising a tubular leg portion from which said foot portion extends.

5. A dance tight worn on the leg and foot and directly contacting the interior of a shoe, said dance tight comprising:

a foot portion terminating at its distal end in an open forefoot collar whereby the toes of a wearer extend through said forefoot collar such that the toes are exposed to directly contact the inner sole of a shoe;

an open hindfoot collar disposed on said foot portion proximally with respect to said forefoot collar whereby the back of the heel of a wearer extends through said hindfoot collar such that the back of the heel is exposed to directly contact the inner back of a shoe; and an open instep collar disposed on said foot portion between said forefoot collar and said hindfoot collar whereby the majority of the instep of a wearer is exposed by said instep collar;

wherein said instep collar defines an open mouth through said foot portion in longitudinal alignment between said hindfoot collar and said forefoot collar such that a hindfoot retention band is formed between said instep collar and said hindfoot collar, whereby said hindfoot retention band is disposed across the bottom of the heel of a wearer, and a forefoot retention band is formed between said instep collar and said forefoot collar, whereby said forefoot retention band is disposed across the ball of the foot of a wearer.

6. The dance tight of claim 5, wherein said foot portion is made of a nylon or polyester material.

7. The dance tight of claim 5, wherein said foot portion comprises an elastic fabric material, said forefoot collar, said instep collar and said hindfoot collar comprising elastic bands having a higher elastic traction than the foot portion fabric material.

8. The dance tight of claim 5, further comprising a tubular leg portion from which said foot portion extends.

* * * * *